US010345747B2

(12) United States Patent
Seshita et al.

(10) Patent No.: US 10,345,747 B2
(45) Date of Patent: Jul. 9, 2019

(54) FIXING DEVICE AND IMAGE FORMING APPARATUS INCORPORATING SAME

(71) Applicants: Takuya Seshita, Kanagawa (JP); Kohichi Utsunomiya, Kanagawa (JP); Hajime Gotoh, Kanagawa (JP); Takahiro Imada, Kanagawa (JP); Yutaka Ikebuchi, Kanagawa (JP)

(72) Inventors: Takuya Seshita, Kanagawa (JP); Kohichi Utsunomiya, Kanagawa (JP); Hajime Gotoh, Kanagawa (JP); Takahiro Imada, Kanagawa (JP); Yutaka Ikebuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/970,819

(22) Filed: May 3, 2018

(65) Prior Publication Data

US 2018/0329342 A1 Nov. 15, 2018

(30) Foreign Application Priority Data

May 11, 2017 (JP) ..... 2017-094372

(51) Int. Cl.
*G03G 15/20* (2006.01)
*G03G 15/16* (2006.01)

(52) U.S. Cl.
CPC ..... *G03G 15/205* (2013.01); *G03G 15/1615* (2013.01); *G03G 15/206* (2013.01);
(Continued)

(58) Field of Classification Search
CPC ..... G03G 15/2025; G03G 15/205; G03G 15/2053; G03G 15/206; G03G 15/2064; G03G 2215/2035
See application file for complete search history.

(56) References Cited

U.S. PATENT DOCUMENTS 8,254,819 B2 * 8/2012 Okamoto ..... G03G 15/2025 399/324
2007/0059060 A1 * 3/2007 Kameda ..... G03G 15/2025 399/329

(Continued)

FOREIGN PATENT DOCUMENTS

JP 2007-079238 3/2007
JP 2011-064726 3/2011

(Continued)

*Primary Examiner* — Carla J Therrien
(74) *Attorney, Agent, or Firm* — Duft & Bornsen, PC

(57) ABSTRACT

A fixing device includes a driving unit, a pressing roller, a heater, a fixing belt, a pressing roller, a nip formation pad that presses against an inner surface of the fixing belt toward the pressing roller via the fixing belt to form a nip, a separation mechanism, a lubricant between the fixing belt and the nip formation pad, and a processor to execute a warming-up operation of the fixing device. In the warming-up operation, before the heater heats the fixing belt, the separation mechanism moves the nip formation pad in a direction of separating the nip formation pad from the pressing roller to set a nip pressure lower than an ordinary nip pressure, and the driving unit rotates the pressing roller that rotates the fixing belt. Thereafter, the heater starts heating, and the separation mechanism moves the nip formation pad to contact the fixing belt at an ordinary nip pressure.

10 Claims, 7 Drawing Sheets

(52) U.S. Cl.
CPC ..... *G03G 15/2025* (2013.01); *G03G 15/2053* (2013.01); *G03G 15/2064* (2013.01); *G03G 2215/2035* (2013.01)

(56) References Cited

U.S. PATENT DOCUMENTS

| | | | | |
|---|---|---|---|---|
| 2010/0021195 | A1* | 1/2010 | Yura | G03G 15/2064 399/70 |
| 2010/0172677 | A1* | 7/2010 | Hosokawa | G03G 15/2064 399/329 |
| 2011/0052277 | A1 | 3/2011 | Ueno et al. | |
| 2011/0064437 | A1 | 3/2011 | Yamashina et al. | |
| 2011/0129268 | A1 | 6/2011 | Ishii et al. | |
| 2011/0150518 | A1 | 6/2011 | Hase et al. | |
| 2011/0222875 | A1 | 9/2011 | Imada et al. | |
| 2011/0222888 | A1 | 9/2011 | Ikebuchi et al. | |
| 2011/0229178 | A1 | 9/2011 | Ogawa et al. | |
| 2012/0237273 | A1 | 9/2012 | Yoshinaga et al. | |
| 2013/0004218 | A1* | 1/2013 | Tsueda | G03G 15/2032 399/329 |
| 2013/0188991 | A1 | 7/2013 | Kawata et al. | |
| 2013/0195477 | A1 | 8/2013 | Seshita et al. | |
| 2013/0209115 | A1 | 8/2013 | Hase et al. | |
| 2013/0209121 | A1 | 8/2013 | Uchitani et al. | |
| 2013/0209131 | A1 | 8/2013 | Uchitani et al. | |
| 2014/0270875 | A1 | 9/2014 | Mimbu et al. | |
| 2014/0369703 | A1 | 12/2014 | Hase et al. | |
| 2015/0055993 | A1 | 2/2015 | Shoji | |
| 2015/0055994 | A1 | 2/2015 | Shoji et al. | |
| 2015/0110531 | A1 | 4/2015 | Takagi et al. | |
| 2015/0125193 | A1* | 5/2015 | Ishii | G03G 15/2042 399/329 |
| 2015/0185671 | A1 | 7/2015 | Ikebuchi et al. | |
| 2015/0227095 | A1 | 8/2015 | Uchitani et al. | |
| 2015/0253707 | A1 | 9/2015 | Suzuki et al. | |
| 2015/0261157 | A1 | 9/2015 | Yamano et al. | |
| 2015/0355585 | A1 | 12/2015 | Suzuki et al. | |
| 2016/0054691 | A1 | 2/2016 | Hase et al. | |
| 2016/0098003 | A1 | 4/2016 | Uchitani et al. | |
| 2016/0124359 | A1 | 5/2016 | Ikebuchi et al. | |
| 2016/0327891 | A1 | 11/2016 | Ikebuchi et al. | |
| 2017/0010569 | A1 | 1/2017 | Seshita et al. | |
| 2017/0146933 | A1 | 5/2017 | Yamano et al. | |
| 2017/0255150 | A1 | 9/2017 | Hase et al. | |
| 2017/0277091 | A1 | 9/2017 | Uchitani et al. | |
| 2018/0217542 | A1* | 8/2018 | Furusawa | G03G 15/2028 |

FOREIGN PATENT DOCUMENTS

| | | |
|---|---|---|
| JP | 2011-081027 | 4/2011 |
| JP | 2013-164451 | 8/2013 |
| JP | 2015-064560 | 4/2015 |
| JP | 2015-064561 | 4/2015 |
| JP | 2015-099352 | 5/2015 |
| JP | 2015-111243 | 6/2015 |
| JP | 2015-145950 | 8/2015 |
| JP | 2015-194661 | 11/2015 |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2017-094372, filed on May 11, 2017 in the Japanese Patent Office, the entire disclosure of which is hereby incorporated by reference herein.

BACKGROUND

Technical Field

The present disclosure relates to a fixing device that heats and fixes a toner image borne on a sheet serving as a recording medium and an image forming apparatus having the fixing device, such as a photocopier, a facsimile machine, a printer, or a multifunction peripheral thereof.

Background Art

Conventional fixing devices installed in an image forming apparatus, such as a copier or a printer, have a known disadvantage in that the fixing device has a large driving torque at the start of driving because a lubricant between a fixing belt and a nip forming member is not sufficiently warm and becomes highly viscous, causing rotation failure.

SUMMARY

This specification describes an improved fixing device and an image forming apparatus including the fixing device.

In one illustrative embodiment, the fixing device includes a driving unit, a pressing roller rotated in a predetermined direction by the driving unit, a heater, a fixing belt heated by the heater, a nip formation pad that presses against an inner circumferential surface of the fixing belt toward the pressing roller via the fixing belt to form a nip through which a sheet is conveyed, a separation mechanism to move the nip formation pad in a direction of separating the nip formation pad from the pressing roller to lower a nip pressure of the nip formation pad with respect to the pressing roller, a lubricant in a portion where the fixing belt comes into sliding contact with the nip formation pad, and a processor to execute a warming-up operation of the fixing device at a predetermined timing. In the warming-up operation, the processor controls the separation mechanism to move the nip formation pad in the direction of separating before the heater heats the fixing belt, and cause the nip formation pad to contact the fixing belt with the nip pressure lower than an ordinary nip pressure, or release the nip formation pad from the fixing belt to set the nip pressure to zero. After the separation mechanism moves the nip formation pad, the processor controls the driving unit to start rotation of the pressing roller that contacts and rotates the fixing belt. After the rotation of the pressing roller, the processor controls the heater to start heating the fixing belt. After the heater starts heating, the processor controls the separation mechanism to release movement of the nip formation pad and cause the nip formation pad to contact the fixing belt at the ordinary nip pressure.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
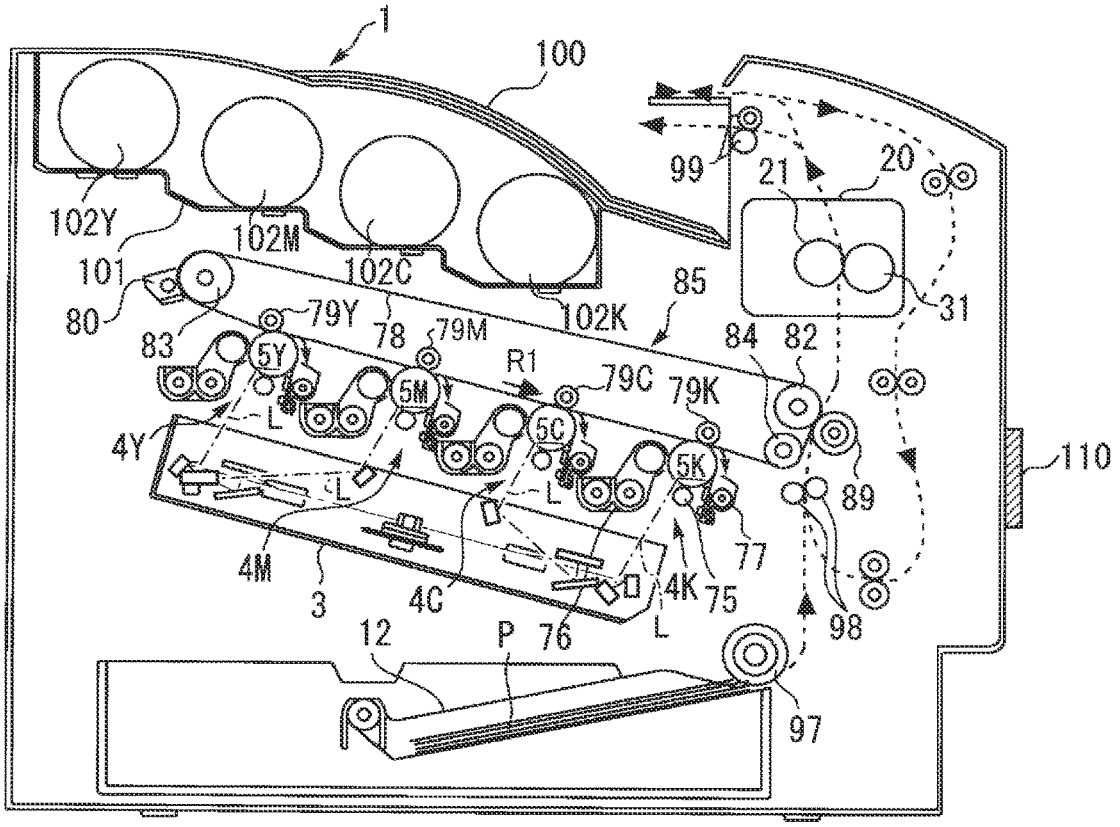
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

Below, a fixing device and an image forming apparatus according to an embodiment of the present disclosure are described below.

With reference to FIG. 1, an overall configuration and operations of an image forming apparatus 1 is described.

As illustrated in FIG. 1, the image forming apparatus 1 according to a present embodiment is a tandem-type color printer. There are four removable toner bottles 102Y, 102M, 102C, and 102K corresponding to yellow, magenta, cyan, and black colors of toner disposed in a bottle holder 101 in the upper part of the image forming apparatus 1.

Under the bottle holder 101, there is provided an intermediate transfer unit 85, which includes an intermediate transfer belt 78. Also, image forming devices 4Y, 4M, 4C, and 4K corresponding to yellow, magenta, cyan, and black colors, respectively, are aligned along and face the intermediate transfer belt 78 of the intermediate transfer unit 85.

The image forming devices 4Y, 4M, 4C, and 4K include photoconductor drums 5Y, 5M, 5C, and 5K, respectively. Each of the photoconductor drums 5Y, 5M, 5C, and 5K is surrounded by a charger 75, a developing device 76, a cleaner 77, a discharger, and the like. Image forming processes including a charging process, an exposure process, a developing process, a primary transfer process, and a cleaning process are performed on each of the photoconductor drums 5Y, 5M, 5C, and 5K, forming yellow, magenta, cyan, and black toner images on the photoconductor drums 5Y, 5M, 5C, and 5K, respectively.

A drive motor drives and rotates the photoconductor drums 5Y, 5M, 5C, and 5K clockwise in FIG. 1. The charger 75 disposed opposite each of the photoconductor drums 5Y, 5M, 5C, and 5K uniformly charges an outer circumferential surface thereof in the charging process.

When the charged outer circumferential surface of each of the photoconductor drums 5Y, 5M, 5C, and 5K reaches an irradiation position where an exposure device 3 is disposed opposite each of the photoconductor drums 5Y, 5M, 5C, and 5K, laser beams L emitted from the exposure device 3 irradiate and scan the photoconductor drums 5Y, 5M, 5C, and 5K, thus forming electrostatic latent images according to yellow, magenta, cyan, and black image data in the exposure process.

When the scanned outer circumferential surface of each of the photoconductor drums 5Y, 5M, 5C, and 5K reaches a developing position where the developing device 76 is disposed opposite each of the photoconductor drums 5Y, 5M, 5C, and 5K, the developing device 76 develops the electrostatic latent image formed on each of the photoconductor drums 5Y, 5M, 5C, and 5K, thus forming yellow, magenta, cyan, and black toner images on the photoconductor drums 5Y, 5M, 5C, and 5K in the developing process.

When the yellow, magenta, cyan, and black toner images formed on the photoconductor drums 5Y, 5M, 5C, and 5K reach primary transfer nips formed between the photoconductor drums 5Y, 5M, 5C, and 5K and the intermediate transfer belt 78 by four primary transfer bias rollers 79Y, 79M, 79C, and 79K pressed against the four photoconductor drums 5Y, 5M, 5C, and 5K via the intermediate transfer belt 78, respectively, the yellow, magenta, cyan, and black toner images formed on the photoconductor drums 5Y, 5M, 5C, and 5K, respectively, are primarily transferred onto the intermediate transfer belt 78 in a primary transfer process. After the primary transfer process, residual toner failed to be transferred onto the intermediate transfer belt 78 slightly remains on the photoconductor drums 5Y, 5M, 5C, and 5K.

When the residual toner on each of the photoconductor drums 5Y, 5M, 5C, and 5K reaches a cleaning position where the cleaner 77 is disposed opposite each of the photoconductor drums 5Y, 5M, 5C, and 5K, a cleaning blade of the cleaner 77 mechanically collects the residual toner from each of the photoconductor drums 5Y, 5M, 5C, and 5K in the cleaning process.

Finally, when the cleaned outer circumferential surface of each of the photoconductor drums 5Y, 5M, 5C, and 5K reaches a discharging position where the discharger is disposed opposite each of the photoconductor drums 5Y, 5M, 5C, and 5K, the discharger eliminates residual potential from each of the photoconductor drums 5Y, 5M, 5C, and 5K.

Thus, a series of image forming processes performed on the photoconductor drums 5Y, 5M, 5C, and 5K is finished.

Then, the toner images formed on the photoconductor drums 5Y, 5M, 5C, and 5K through the developing process are transferred therefrom and superimposed one on another on the intermediate transfer belt 78. In this manner, a multicolor toner image is formed on the intermediate transfer belt 78.

For example, the intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80. The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82, drives and rotates the intermediate transfer belt 78 counterclockwise in FIG. 1 or in a rotation direction indicated by arrow R1 in FIG. 1.

The four primary transfer bias rollers 79Y, 79M, 79C, and 79K sandwich the intermediate transfer belt 78 together with the four photoconductor drums 5Y, 5M, 5C, and 5K, respectively, thus forming the four primary transfer nips between the intermediate transfer belt 78 and the photoconductor drums 5Y, 5M, 5C, and 5K. The primary transfer bias rollers 79Y, 79M, 79C, and 79K are applied with a primary transfer bias having a polarity opposite a polarity of electric charge of toner.

The intermediate transfer belt 78 is moved in the direction indicated by arrow R1 and sequentially passes through the primary transfer nips formed by the primary transfer bias rollers 79Y, 79M, 79C, and 79K. Then, the single-color toner images are primarily transferred from the photoconductor drums 5Y, 5M, 5C, and 5K and superimposed one on another on the intermediate transfer belt 78.

Thereafter, the yellow, magenta, cyan, and black toner images superimposed on the intermediate transfer belt 78 reach a secondary transfer position where a secondary transfer roller 89 is disposed opposite the intermediate transfer belt 78. At the secondary transfer position, the secondary transfer backup roller 82 sandwiches the intermediate transfer belt 78 together with the secondary transfer roller 89, thus forming a secondary transfer nip between the secondary transfer roller 89 and the intermediate transfer belt 78. The yellow, magenta, cyan, and black toner images superimposed on the intermediate transfer belt 78 are secondarily transferred onto a sheet P conveyed through the secondary transfer nip in a secondary transfer process. At this time, residual toner, which is not transferred to the sheet P, is left on the intermediate transfer belt 78.

Subsequently, the residual toner on the intermediate transfer belt 78 reaches a position facing the intermediate transfer belt cleaner 80. At the position, the residual toner on the intermediate transfer belt 78 is collected.

Thus, a sequence of image forming processes performed on the intermediate transfer belt 78 is completed.

The sheet P conveyed through the secondary transfer nip is conveyed from a sheet feeder 12, which is situated in a lower portion of the image forming apparatus 1, through a feed roller 97, a registration roller pair 98 (e.g., a timing roller pair), and the like.

Specifically, multiple sheets P such as transfer papers are stacked in the sheet feeder 12. The feed roller 97 rotates counterclockwise in FIG. 1 to feed the sheet P on the top in the sheet feeder 12 toward a nip of the registration roller pair 98.

The sheet P conveyed to the registration roller pair 98 temporarily stops at the roller nip formed between the registration roller pair 98, as the registration roller pair 98 stops rotating. The registration roller pair 98 resumes rotating to transport the sheet P to the secondary transfer nip, timed to coincide with the arrival of the multicolor toner image on the intermediate transfer belt 78. Thus, a desired multicolor toner image is transferred to the sheet P.

Subsequently, the sheet P bearing the multicolor toner image is transported to a fixing device 20. In the fixing device 20, a fixing belt 21 and a pressing roller 31 apply heat and pressure to the sheet P to fix the multicolor toner image on the sheet P in a fixing process.

Thereafter, the sheet P bearing the fixed toner image is ejected by an output roller pair 99 onto an outside of the image forming apparatus 1. The sheet P ejected by the output roller pair 99 onto the outside of the image forming apparatus 1 is stacked on an output tray 100 as a print.

Thus, a sequence of image forming processes performed in the image forming apparatus 1 is completed.

With reference to FIGS. 2 to 7, a description is given of a configuration and operation of the fixing device 20 disposed in the image forming apparatus 1. The fixing device 20 is a device that conveys and heats the sheet P bearing unfixed toner image on the sheet P.

As illustrated in FIGS. 2 to 4B, the fixing device 20 includes a fixing belt 21 serving as a belt member, a nip formation pad 26, a brace 23, a heater 25 serving as heat source, a reflector 27, a pressing roller 31, a temperature sensor 40 serving as a temperature detector, a sheet member 22 serving as a lubricant supplier, and a separation mechanism 50.

The fixing belt 21 is an endless belt that contacts the pressing roller 31 and is driven to rotate following the rotation of the pressing roller 31 by friction between the pressing roller 31 and the fixing belt 21 (hereinafter referred to as a driven rotation of the fixing belt 21). The fixing belt 21 is a thin and flexible endless belt and driven to rotate counterclockwise in a direction indicated by arrow Y8 in FIG. 2 by friction between the pressing roller 31 and the fixing belt 21. The fixing belt 21 includes a base layer that constitutes an inner circumferential surface of the fixing belt 21 and a sliding contact surface to the nip formation pad, an elastic layer coating the base layer, and a release layer coating the elastic layer, which produce a total thickness of the fixing belt 21 not greater than 1 mm.

The base layer, having a thickness of about 30 micrometers to about 50 micrometers, is made of a metal such as nickel or stainless steel or a resin such as polyimide.

The elastic layer, having a thickness of 100 micrometers to 300 micrometers, is made of rubber such as silicone rubber, silicone rubber foam, or fluoro rubber. The elastic layer absorbs slight surface asperities of the fixing belt 21 at a nip, facilitating even heat conduction from the fixing belt 21 to the toner image T on the sheet P and thereby suppressing formation of a faulty toner image on the sheet P.

The release layer, having a thickness of 5 micrometers to 50 micrometers, is made of tetrafluoroethylene-perfluoroalkylvinylether copolymer (PFA), polytetrafluoroethylene (PTFE), polyimide (PI), polyether imide (PEI), polyethersulfone (PES), or the like. The release layer facilitates separation or peeling-off of toner of the toner image T on the sheet P from the fixing belt 21.

The nip formation pad 26, the heater 25 serving as the heat source, the brace 23, the sheet member 22, the reflector 27, and the like are installed inside the fixing belt 21, that is, at an inner circumferential surface side of the fixing belt 21.

The nip formation pad 26 presses against the pressing roller 31 via the fixing belt 21 at the inner side of the fixing belt 21, that is, the inner circumferential surface side of the fixing belt 21 to form the nip through which the sheet P is conveyed. That is, the nip formation pad 26 is disposed to contact the inner circumference surface of the fixing belt 21, which slides over the nip formation pad 26. The nip formation pad 26 pressing against the pressing roller 31 via the fixing belt 21 forms the nip through which the sheet P is conveyed.

Figure 2:
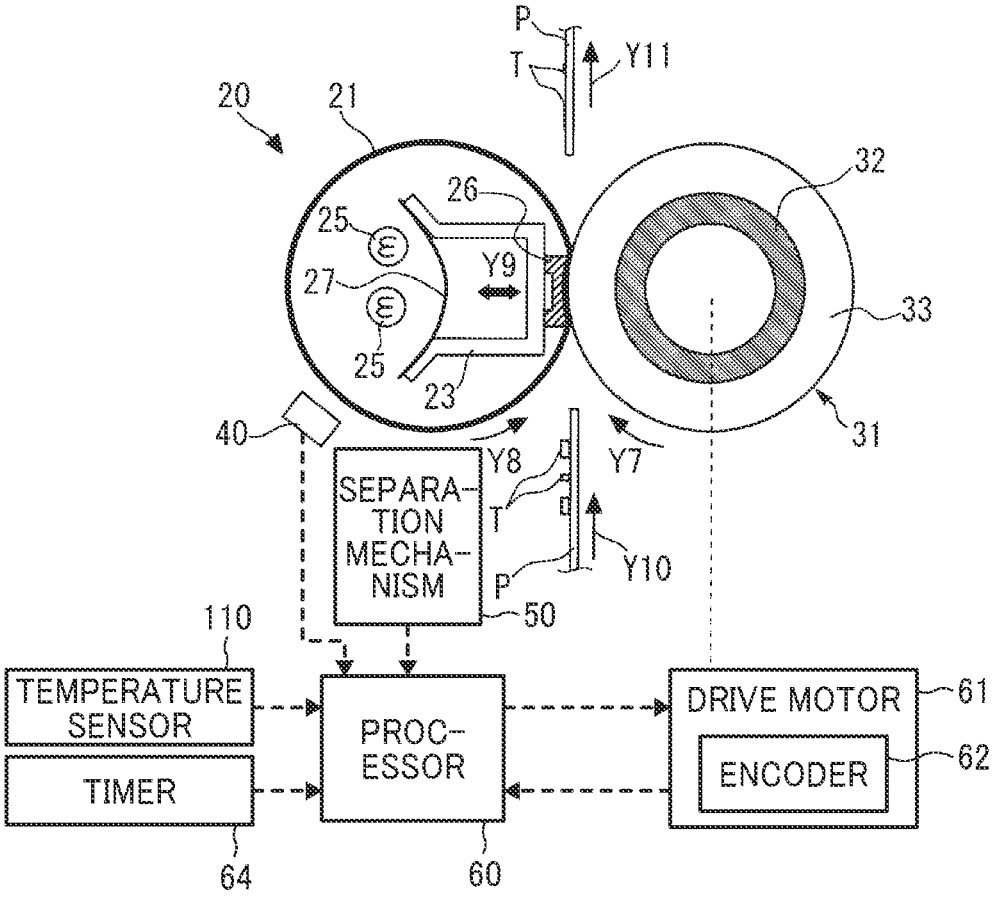
FIG. 2 is a schematic diagram illustrating a configuration of a fixing device of the image forming apparatus.
Figure 3A:
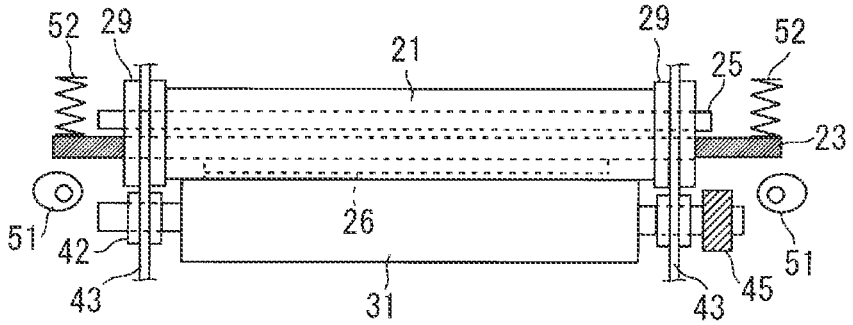
FIG. 3A is an explanatory diagram illustrating a state in which a nip formation pad forms a nip.
Figure 3B:
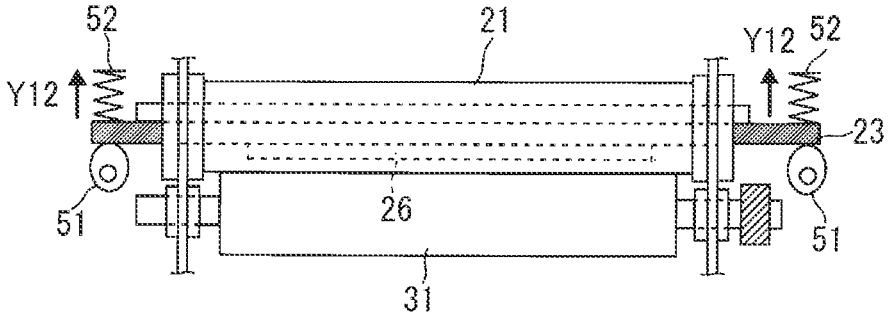
FIG. 3B is an explanatory diagram illustrating a state in which the nip formation pad is separated.

As illustrated in FIGS. 2, 3A, 3B, etc., the nip formation pad 26 is joined to the brace 23 by one or more screws or the like. The nip formation pad 26 is configured to be movable together with the brace 23 by the separation mechanism 50 in the directions indicated by a double-headed arrow Y9 in FIG. 2, described in detail later.

The heater 25 disposed inside the fixing belt 21 serve as a heating means, and the radiant heat of the heater 25 directly heats the fixing belt 21. That is, the heater 25 as the heating means heats the fixing belt 21 to heat the sheet P. The heater 25 serving as the heating means is configured to heat, as a heating area, an area different from the nip in a circumferential direction of the fixing belt 21.

Specifically, the heater 25 serving as the heating means includes a halogen heater (or a carbon heater). Both ends of the heater 25 in a longitudinal direction thereof parallel to an axial direction of the fixing belt 21 are mounted on side plates 43 of the fixing device 20, respectively, as illustrated in FIG. 3. Radiant heat from the heater 25 serving as the heating means whose output is controlled by a processor 60 mainly heats the heating area on the fixing belt 21 different from the nip. The heating area faces the heater 25 and is illustrated by a broken line in FIG. 6B. From the surface of the heated fixing belt 21, heat is applied to the toner image T on the sheet P. Output of the heater 25 is controlled based on the temperature of the outer circumferential surface of the fixing belt 21 detected by the temperature sensor 40. The temperature sensor 40 includes a thermistor or a thermopile disposed opposite the outer circumferential surface of the fixing belt 21. Thus, the fixing belt 21 is heated to a desired fixing temperature by the heater 25 controlled as described above.

In this embodiment, two heaters 25 serving as the heating means are provided inside the fixing belt 21, but one or more heaters may be provided on the inside of the fixing belt 21.

The heater 25 does not heat a part of the fixing belt 21 locally but does heat the fixing belt 21 throughout a relatively wide span in the circumferential direction of the fixing belt 21. Accordingly, even if the fixing belt 21 rotates at high speed, the heater 25 sufficiently heats the fixing belt 21, thus preventing fixing failure. The fixing device 20 can effectively heat the fixing belt 21 with a relatively simple configuration. Therefore, the fixing device 20 can be shortened in warming-up time and first print time as well as reduced in size.

In particular, in the fixing device 20 of the present embodiment, the fixing belt 21 configured to be directly heated by the heater 25 serving as the heating means enables improvement of the heating efficiency of the fixing belt 21, downsizing of the fixing device 20, and cost reduction of the fixing device 20.

Figure 5:
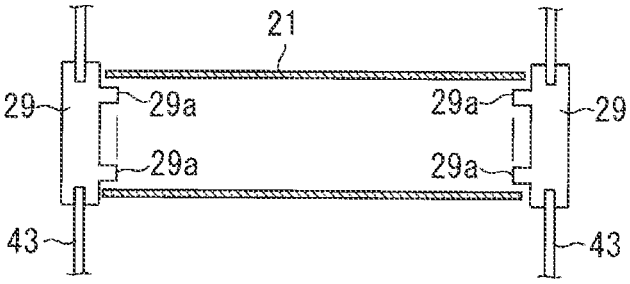
FIG. 5 is a schematic diagram illustrating the fixing belt and guides at both sides of the fixing belt.

With reference to FIG. 5, guide members 29 that are flanges guide both ends of the fixing belt 21 in the width direction from the inner circumferential surface side of the fixing belt 21 so that a substantially cylindrical posture of the fixing belt 21 is maintained.

Specifically, the two guide members 29 are made of a heat-resistant resin material or the like, and are fitted into the side plates 43 at both ends of the fixing device 20 in the width direction, respectively. The guide member 29 includes a guide surface 29*a* to hold the fixing belt 21 while maintaining the substantially cylindrical posture of the fixing belt 21, a stopper to restrict the movement of the fixing belt 21 in the width direction, that is belt skew, and the like.

The guide members 29 are arranged at both ends in the width direction of the fixing belt 21 and in a peripheral area of the fixing belt 21 except for the nip so as not to hamper formation of the nip by the nip formation pad 26.

According to the present embodiment, a member that contacts the inner circumferential surface of the fixing belt 21 is only the guide member 29 that loosely contacts each end of the fixing belt 21 and the nip formation pad 26 that contacts the fixing belt 21 via the sheet member 22 actually. There is no other belt guide that contacts the inner circumferential surface of the fixing belt 21 to guide the fixing belt 21 as the fixing belt 21 rotates.

As described above, in the fixing device 20 according to the present embodiment, in order to further improve the heating efficiency of the fixing belt 21 and to reduce the cost and size of the fixing device 20, a pipe-shaped heating member is removed from the fixing device 20. Without using the pipe-shaped heating member, the heater 25 serving as the heating means directly heats the fixing belt 21.

In the present embodiment, the brace 23 is disposed inside the loop formed by the fixing belt 21 to contact the pressing roller 31 via the nip formation pad 26 and the fixing belt 21. The brace 23 reinforces the nip formation pad 26 that forms the nip, and is coupled to the nip formation pad 26 by one or more screws or the like.

With reference to FIGS. 3A and 3B, the brace 23 has a length in a longitudinal direction thereof parallel to the axial direction of the fixing belt 21 that is longer than a length of the nip formation pad 26 in the longitudinal direction thereof. The brace 23 is supported by the side plate 43 of the fixing device 20 at each end of the brace 23 in the longitudinal direction thereof to be movable in the vertical direction in FIGS. 3A and 3B that is the arrow Y9 direction in FIG. 2.

Since the brace 23 presses against the pressing roller 31 via the nip formation pad 26 and the fixing belt 21, the brace 23 prevents a disadvantage of substantial deformation of the nip formation pad 26 at the nip that is caused by pressure from the pressing roller 31. The brace 23 is made of metal having an increased mechanical strength, such as stainless steel and iron, to attain the advantages described above.

In the present embodiment, the reflector 27 is fixed between the brace 23 and the heater 25. The reflector 27 reflects heat radiated from the heater 25 toward the brace 23, that is, infrared light that heats the brace 23 to heat the fixing belt 21. This improves heating efficiency of the fixing belt 21. The reflector 27 is made of aluminum, stainless steel, or the like.

An opposed face of the brace 23 is disposed opposite the heater 25 and may be partially or entirely coated with an insulator or given a mirror finish, which gives an advantage similar to the reflector 27.

With reference to FIG. 2, the pressing roller 31 serving as a pressing rotating member includes an elastic layer 33 provided on a core bar 32 that is a shaft portion, and is driven by a drive motor 61 as a driving unit in a predetermined direction (clockwise in FIG. 2).

The core bar 32 of the pressing roller 31 is a hollow structure formed of a metal material. The elastic layer 33 of the pressing roller 31 is made of silicone rubber foam, silicone rubber, fluoro rubber, or the like. Optionally, a thin release layer made of PFA, PTFE, or the like may cover an outer circumferential surface of the elastic layer 33. The pressing roller 31 is pressed against the fixing belt 21 to form the desired nip between the pressing roller 31 and the fixing belt 21. With reference to FIGS. 3A and 3B, the pressing roller 31 mounts a gear 45 that engages a driving gear of the drive motor 61 so that the pressing roller 31 is driven and rotated clockwise in FIG. 2 in the rotation direction Y7. The pressing roller 31 is rotatably mounted on and supported by the side plate 43 of the fixing device 20 through a bearing 42 at each end of the pressing roller 31 in an axial direction thereof.

If the elastic layer 33 of the pressing roller 31 is made of sponge such as silicone rubber foam, the elastic layer 33 decreases pressure exerted to the nip, thus reducing load to the nip formation pad 26. Additionally, the elastic layer 33 made of sponge enhances thermal insulation of the pressing roller 31, reducing heat conduction from the fixing belt 21 to the pressing roller 31 and thereby improving heating efficiency of the fixing belt 21.

Figure 4A:
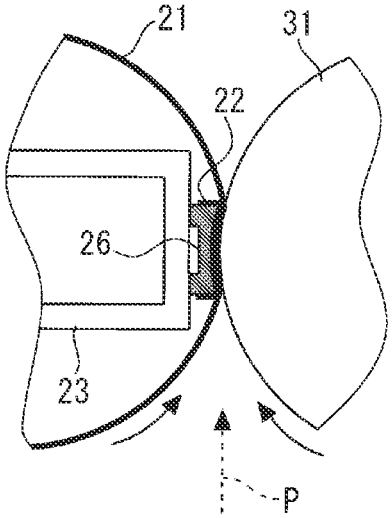
FIG. 4A is an enlarged view illustrating a vicinity of the nip which the nip formation pad forms.

With reference to FIG. 4A, the nip formation pad 26 that contacts the fixing belt 21 and over which the fixing belt 21 slides has a curved cross-section to produce a recess that causes the fixing belt 21 to conform to the curve of the pressing roller 31. Accordingly, the sheet P sandwiched between the curved fixing belt 21 and the curved pressing roller 31 is directed to the pressing roller 31 as the sheet P is ejected from the nip. Such arrangement prevents a failure caused by the sheet P that is attracted to the fixing belt 21 in the nip and does not separate from the fixing belt 21.

In the present embodiment, the shape of the nip formation pad 26 forming the nip is formed in a concave shape. In some embodiments, the shape of the nip formation pad 26 forming the nip may be formed in a planar shape. That is, a sliding contact surface of the nip formation pad 26 that is a face opposing the pressing roller 31 may be formed in the planar shape. The planar shape makes the shape of the nip substantially parallel to an image surface of the sheet P, enhances an adhesion between the fixing belt 21 and the sheet P, and improves fixing performance. Additionally, a curvature of the fixing belt 21 at an exit of the nip is greater than that of the pressing roller 31, facilitating separation of the sheet P ejected from the nip from the fixing belt 21.

Material to form the nip formation pad 26 may be made of a metal material, but preferable material is resin material having heat resistance, thermal insulation, and rigidity that is enough not to bend greatly under pressing force of the pressing roller 31, such as liquid crystal polymer (LCP), polyamide imide (PAI), polyether sulfone (PES), polyphenylene sulfide (PPS), polyether nitrile (PEN), polyether ether ketone (PEEK), or the like. In the present embodiment, a liquid crystal polymer (LCP) is used as the material of the nip formation pad 26.

Figure 4B:
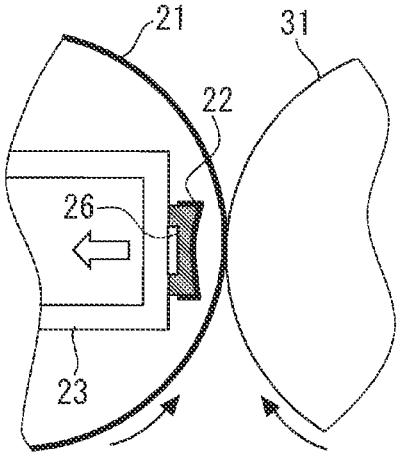
FIG. 4B is an enlarged view illustrating the nip, where the nip formation pad separates from a fixing belt.

With reference to FIGS. 4A and 4B, the nip formation pad 26 is covered by the sheet member 22 that is made of a low friction material such as polytetrafluoroethylene (PTFE) to decrease sliding friction with the fixing belt 21. Specifically, the sheet member 22 is disposed to cover a part or the whole circumference of the nip formation pad 26 that is the circumference of the nip formation pad in a cross section illustrated in FIGS. 4A and 4B so as to be interposed between the nip formation pad 26 and the fixing belt 21 at almost the entire width in the width direction at the nip. In addition, the sheet member 22 in the present embodiment is formed of a fiber material impregnated with a lubricant. The fiber material is a cloth member made of a fluororesin such as PTFE. With this configuration, the lubricant is held on the surface where the nip formation pad 26 and the fixing belt 21 are in contact with each other. Therefore, a disadvantage of wear of both the nip formation pad 26 and the fixing belt 21 by sliding contact between the nip formation pad 26 and the fixing belt 21 is reduced.

As the lubricant impregnated in the sheet member 22, grease such as fluorine grease, silicone grease, oil such as silicone oil, or the like may be used. In the present embodiment, grease is used as a lubricant to be impregnated in the sheet member 22 because the grease stays in the sheet member 22 for a long time and easily gives a lubricating effect over a long period of time.

As described above, in the present embodiment, providing the sheet member 22 impregnated the lubricant between the nip formation pad 26 and the fixing belt 21 leads to existence of lubricant in a portion where the fixing belt 21 indirectly rubs against the nip formation pad 26. On the other hand, by directly applying the lubricant between the nip formation pad 26 and the fixing belt 21 without installing the sheet member 22 impregnated with the lubricant, the lubricant may exist in a portion where the fixing belt 21 directly rubs against the nip formation pad 26. In particular, the use of grease as a lubricant maintains a state in which the lubricant intervenes between the fixing belt 21 and the nip formation pad 26 well over time.

The fixing device 20 according to the present embodiment includes the separation mechanism 50 as another part described above. The separation mechanism 50 is described later in detail.

A description is provided of an ordinary fixing operation performed by the fixing device 20 having the construction described above.

As the main body of the image forming apparatus 1 is powered on, the heater 25 is supplied with power and the driver starts driving and rotating the pressing roller 31 clockwise in FIG. 2 in the rotation direction Y7. Accordingly, the pressing roller 31 drives and co-rotates the fixing belt 21 in the rotation direction Y8 by friction at the nip between the pressing roller 31 and the fixing belt 21.

Thereafter, the sheet P is fed from the sheet feeder 12, an unfixed color image is transferred onto the sheet P at the position of the secondary transfer roller 89, and the unfixed color image is borne on the sheet P. The sheet P bearing the unfixed image T that is a toner image T is guided by a guide plate, conveyed in the direction of the arrow Y10 in FIG. 2, and enters the nip where the fixing belt 21 and the pressing roller 31 press against each other.

The toner image T is fixed on a surface of the sheet P under heat from the fixing belt 21 heated by the heater 25 and pressure exerted from the fixing belt 21 and the pressing roller 31 pressed against the nip formation pad 26 reinforced by the brace 23 via the fixing belt 21. The sheet P ejected from the nip is conveyed in a sheet conveyance direction Y11.

A description is provided of a unique configuration and a unique operation of the fixing device 20 according to the present embodiment in detail.

As described above with reference to FIG. 2 and the like, the fixing device 20 according to the present embodiment includes the pressing roller 31, the fixing belt 21, the nip formation pad 26, and other members.

The pressing roller 31 is a roller member driven to rotate in a predetermined direction, clockwise in FIG. 2, by a drive motor 61 as a driving unit.

The fixing belt 21 is an endless belt that is heated by the heater 25 serving as the heating means, contacts the pressing roller 31, and is driven to rotate following the rotation of the pressing roller 31 by friction between the pressing roller 31 and the fixing belt 21.

The nip formation pad 26 is a rigid body that presses against the pressing roller 31 via the fixing belt 21 on the inner side of the fixing belt 21 to form the nip through which the sheet P is conveyed.

A lubricant is interposed in a portion where the fixing belt 21 indirectly comes into sliding contact with the nip formation pad 26 via the sheet member 22. Specifically, in the present embodiment, the sheet member 22 that covers the nip formation pad 26 is impregnated with grease as a lubricant.

Referring to FIGS. 2, 3A, and 3B, the fixing device 20 according to the present embodiment includes the separation mechanism 50 having a cam 51, a compression spring 52, and the like. The separation mechanism 50 moves the nip formation pad 26 in a direction away from the pressing roller 31, that is, in one of the directions of the arrow Y9 in FIG. 2 and in a direction of an arrow Y12 in FIG. 3B, and reduces a nip pressure (that is a contact pressure) with which the nip formation pad 26 presses the pressing roller 31. In particular, the separation mechanism 50 according to the present embodiment moves the brace 23 together with the nip formation pad 26 in the aforementioned direction away from the pressing roller 31 (hereinafter appropriately referred to as a separation direction).

Specifically, the separation mechanism 50 includes a pair of cams 51 installed to be capable of pushing both ends in the width direction of the brace 23 with which the nip formation pad 26 is integrally installed, a cam motor to drive and rotate the cam 51, and a pair of compression springs 52 that urges the brace 23 integrally provided with the nip formation pad 26 toward the nip, and the like.

When the processor 60 controls the cam motor to set the cam 51 to a position illustrated in FIG. 3A, that is, a position that the cam 51 does not push the brace 23, an urging force of the compression spring 52 is applied to the brace 23 together with the nip formation pad 26 toward the pressing roller 31. The urging force presses the nip formation pad 26 against the pressing roller 31 at a predetermined nip pressure via the fixing belt 21 to form the desired nip. In such a state illustrated in FIG. 2, FIG. 3A, and FIG. 4A, the fixing process described above is performed.

On the other hand, when the processor 60 controls the cam motor to set the cam 51 to a position illustrated in FIG. 3B, that is, a position that the cam 51 pushes the brace 23, the cam 51 resists the urging force of the compression spring 52 and moves the brace 23 together with the nip formation pad 26 in the separation direction. The movement of the cam 51 reduces the nip pressure at the nip. In the present embodiment, such an operation of the separation mechanism 50 completely separates the nip formation pad 26 from the fixing belt 21, eliminates the nip, and sets the nip pressure to zero. In such a state as illustrated in FIG. 3B and FIG. 4B, a warming-up operation (a first warming-up operation) of the fixing device starts as described below.

In the fixing device 20 according to the present embodiment, the warming-up operation (the first warming-up operation) is performed at a predetermined timing before the fixing process is started, that is, before the sheet P enters the nip.

When the processor 60 according to the present embodiment does not perform the warming-up operation (the first warming-up operation), the processor 60 performs the second warming-up operation, which is described later.

Figure 6A:
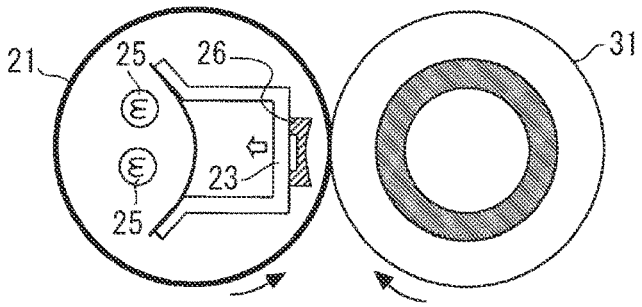
FIG. 6A is a schematic explanatory diagram illustrating a start of a warming-up operation of the fixing device.

Referring to FIG. 6A, a first stage of the warming-up operation (the first warming-up operation) is described. Before the heater 25 serving as the heating means heats the fixing belt 21, the separation mechanism 50 moves the nip formation pad 26 in the separation direction indicated by a white arrow in FIG. 6A that is a direction away from the pressing roller 31 so that the nip formation pad 26 contacts the fixing belt 21 at the nip pressure zero. When the pressing roller 31 starts to rotate in a state in which the fixing belt 21 contacts the pressing roller 31, the driven rotation of the fixing belt 21 starts.

That is, immediately after the start of the warming-up operation, the drive motor 61 is operated and rotates the pressing roller 31 and the fixing belt 21 in directions of arrows illustrated in FIG. 6A in a state in which the heater 25 is in an OFF state and the nip formation pad 26 does not form the nip. Although the nip pressure on the fixing belt 21 is substantially zero because the nip formation pad 26 does not press the fixing belt 21, the fixing belt 21 contacts the pressing roller 31 because the guide member 29 guides the fixing belt 21 to maintain its substantially cylindrical attitude. Therefore, as the drive motor 61 rotates the pressing roller 31, a friction force between the fixing belt 21 and the pressing roller 31 also causes the fixing belt 21 to rotate.

Preferably sliding friction between the guide member 29 and the fixing belt 21 is lowered to improve co-rotation of the fixing belt 21 in a state in which the nip is not formed. Specifically, it is preferable to set roughness of the guide surface 29*a* of the guide member 29 roughly or to set the contact area of the guide surface 29*a* small.

Figure 6B:
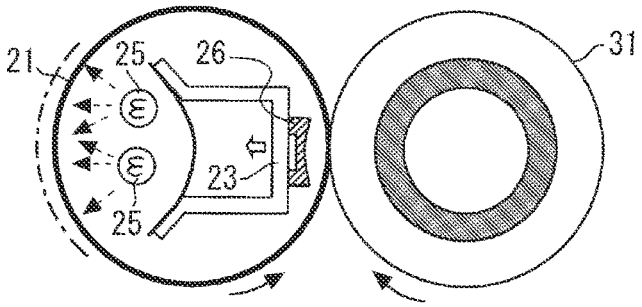
FIG. 6B is a schematic explanatory diagram illustrating a start of heating of the warming-up operation of the fixing device.
Figure 6C:
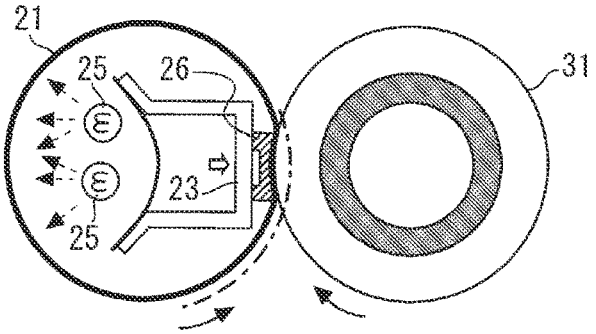
FIG. 6C is a schematic explanatory diagram illustrating an ordinary nip formation in the warming-up operation of the fixing device.

Next, referring to FIG. 6B, as a second stage of the warming-up operation, after driving without formation of the nip as illustrated in FIG. 6A, the heater 25 as the heating means starts to heat the fixing belt 21. As a third stage, referring to FIG. 6C, the separation mechanism 50 releases the movement of the nip formation pad 26 such that the nip formation pad 26 contacts the fixing belt 21 at the nip pressure in an ordinary state that is the fixing process.

That is, the separation mechanism 50 moves the nip formation pad 26 to separate from the fixing belt 21, the drive motor 61 starts to rotate. After a while, by shifting the on-timing of the heater 25, the heater 25 which is in an off state is shifted to an on state. Then, after a while from the on timing of the heater 25, the separation mechanism 50 leads the nip formation pad 26 to contact the fixing belt 21 and form the nip that is an ordinary nip in the fixing process. After the fixing device 20 drives for a while in this state, the warming-up operation is completed.

The warming-up operation (the first warming-up operation) is performed before the fixing process because the fixing device 20 stopping its drive does not sufficiently warm the lubricant interposed at a sliding part in which the fixing belt 21 and the sheet member 22 on the nip formation pad 26 slide over each other, which easily causes higher viscosity of the lubricant and losing function of the lubricant that results in a large driving torque of the fixing device 20 and the drive motor 61 and slip between the fixing belt 21 and the pressing roller 31 that results in failure of driven rotation of the fixing belt 21 if the fixing device 20 has the ordinary nip and is driven with lubricant having such the higher viscosity. An inadequate and unstable driven rotation of the fixing belt 21 causes the fixing belt 21 heated by the heater 25 to heat a part of the fixing belt 21 in the circumferential direction and uneven heating in the circumferential direction of the fixing belt 21. Particularly, when the fixing belt 21 in which the rotation stops because of slip is heated by the heater 25, a part of the fixing belt 21 is intensively heated, and concave plastic deformation called "kink" occurs in the fixing belt 21.

As time from a stop of driving of the fixing device 20 (stop time) becomes longer, these problems become conspicuous since temperature of the lubricant drops and the viscosity tends to become higher.

On the other hand, in the present embodiment, even if the viscosity of the lubricant becomes higher at the start of driving of the fixing device 20, the separation mechanism 50 moves the nip formation pad 26 in the separation direction firstly as the first stage of the warming-up operation such that the fixing belt 21 contacts the pressing roller 31 with smaller force than an ordinary force in the fixing process, and the drive motor 61 rotates the pressing roller 31 to rotate the fixing belt 21 by friction between the fixing belt 21 and the pressing roller 31. This leads the driving torque of the fixing device 20 (and the driving torque of the drive motor 61) to be smaller than the one when the fixing device 20 having the ordinary nip is driven. Additionally, in the present embodiment, since the heater 25 does not heat the fixing belt 21, the fixing belt 21 is not locally heated even if the driven rotation of the fixing belt 21 is unstable.

After the fixing belt 21 is driven for a while without forming the nip and heating, and after the driven rotation of the fixing belt 21 becomes stable, the heater 25 heats the fixing belt 21 as a second stage of the warming-up operation. Since the driven rotation of the fixing belt 21 becomes stable after the fixing belt 21 is driven for a while without forming the nip, heating of the fixing belt 21 by the heater 25 does not cause disadvantage of local heating of the fixing belt 21. At this time, the heater 25 warms the lubricant adhering to the inner circumferential surface of the fixing belt 21 and the viscosity thereof is reduced.

Subsequently, after the fixing belt 21 is heated and driven for a while without forming the nip, and after a first heated region of the fixing belt 21 that is illustrated by an alternate long and short dash line in FIG. 6B reaches a position opposing the nip formation pad 26 at the latest, the separation mechanism 50 shifts a state of the fixing device 20 from a non-nip-formation state to a nip-formation state as the third stage of the warming-up operation. When the first heated region of the fixing belt 21 reaches the position opposite the nip formation pad 26, heat of the first heated area warms the lubricant impregnated in the sheet member 22 on the nip formation pad 26 and decreases the viscosity of the lubricant. Therefore, driving the fixing device 20 forming the ordinary nip with the lubricant having sufficiently low viscosity interposed at the nip prevents the disadvantage caused by the large driving torque of the fixing device 20 (and the drive motor 61) and a rotation failure of the fixing belt 21.

As described above, in the present embodiment, since the processor 60 performs the warming-up operation (the first warming-up operation) at a predetermined timing when driving of the fixing device 20 is started, even when the viscosity of the lubricant is high, the driving torque of the fixing device 20 (and the drive motor 61) does not become so large, and the disadvantage caused by the fixing belt 21 a part of which is locally heated by unstable driven rotation of the fixing belt 21 is prevented.

In the warming-up operation (the first warming-up operation), the heating temperature of the heater 25 is set a temperature sufficient to warm the lubricant, and the temperature at which thermal deterioration does not occur even if the fixing belt 21 is heated in a stopped state. That is, the electric power supplied to the heater 25 during the warming-up operation is set to be smaller than the rated electric power and smaller than the electric power supplied to the heater 25 during the fixing process.

In the present embodiment, when the processor 60 executes the warming-up operation (the first warming-up operation), as the first stage, the processor 60 controls the drive motor 61 to start rotation of the pressing roller 31 that starts the driven rotation of the fixing belt 21 and, after rotation of the drive motor 61 becomes stable, as the second stage, the heater 25 starts to heat the fixing belt 21.

Specifically, as illustrated in FIG. 2, the drive motor 61 includes an encoder 62 to detect the rotational speed of the pressing roller 31 (and the drive motor 61). The unstable driven rotation of the fixing belt 21 that is driven to rotate together with the pressing roller 31 causes unstable rotation of the pressing roller (and the drive motor 61), which can be detected by the encoder 62. When values of rotational speed and its fluctuation that are detected by the encoder 62 each become ordinary values, the processor 60 determines that the driven rotation of the fixing belt 21 becomes stable and proceeds the warming-up operation form the first stage to the second stage, which enables to prevent the disadvantage caused by the fixing belt 21 a part of which is locally heated effectively.

In the present embodiment, the encoder 62 detects the rotational speed of the pressing roller 31, and the processor 60 proceeds the warming-up operation from the first stage to the second stage based on the results detected by the encoder 62, but the rotational speed of the fixing belt 21 may be directly detected, and the processor 60 may proceed the warming-up operation from the first stage to the second stage based on the directly detected results.

In the present embodiment, the processor 60 proceeds the warming-up operation from the first stage to the second stage after detecting the stable rotation of the drive motor 61. However, the processor 60 may start the second stage of the warming-up operation after a predetermined time has passed from the start of the first stage of the warming-up operation.

That is, when the processor 60 executes the warming-up operation (the first warming-up operation), as the first stage, the pressing roller 31 starts to rotate and the fixing belt 21 starts to be rotated by the pressing roller 31, and, after the predetermined time has passed from the start of the rotation of the pressing roller 31, as the second stage, the heater 25 may start to heat the fixing belt 21.

Specifically, a timer 64 illustrated in FIG. 2 measures the time from the start of the first stage of the warming-up operation, and when the measured time reaches the predetermined time, the processor 60 proceeds the warming-up operation to the second stage. The above described predetermined time is set to a time during which the driven rotation of the fixing belt 21 is sufficiently stabilized after the start of the first stage of the warming-up operation.

The processor 60 may proceed the warming-up operation from the first stage to the second stage after the predetermined time has passed from the start of the first stage of the warming-up operation and the encoder detects the stable rotation of the drive motor 61. Alternatively, after the predetermined time has passed since the stable rotation of the drive motor 61 is detected, the processor 60 may control to proceed the warming-up operation from the first stage to the second stage.

In the present embodiment, when the processor 60 executes the warming-up operation (the first warming-up operation), as the second stage, the heater 25 as the heating means starts to heat the fixing belt 21. After the predetermined time has passed since the heater 25 starts to heat the fixing belt 21, as the third stage, the separation mechanism 50 releases the movement of the nip formation pad 26 such that the nip formation pad 26 contacts the fixing belt 21 at the nip pressure in an ordinary state that is the fixing process.

Specifically, the timer 64 illustrated in FIG. 2 measures the time from the start of the second stage of the warming-up operation, and when the measured time reaches the predetermined time, the processor 60 proceeds the warming-up operation from the second stage to the third stage. The predetermined time described above is set to a time when the rotation of the fixing belt 21 leads to the first heated region of the fixing belt 21 that is heated by the heater 25 and illustrated by an alternate long and short dash line in FIG. 6B to reach the position opposite the nip formation pad 26 at the latest after the start of the second stage of the warming-up operation.

Therefore, the lubricant impregnated in the sheet member 22 of the nip formation pad 26 is warmed, and the viscosity of the lubricant becomes lower. Even when the fixing device 20 has the ordinary nip, the disadvantage caused by the large driving torque of the fixing device 20 (and the drive motor 61) and a rotation failure of the fixing belt 21 are prevented.

In the present embodiment, the processor 60 starts the third stage of the warming-up operation after a predetermined time has passed from the start of the second stage of the warming-up operation. However, the processor 60 may proceed the warming-up operation from the second stage to the third stage based on the temperature of the fixing belt 21 detected by the temperature sensor 40.

Specifically, when the processor 60 executes the warming-up operation (the first warming-up operation), as the second stage, the heater 25 as the heating means starts to heat the fixing belt 21. After the temperature detected by the temperature sensor 40 (fixing temperature) exceeds a predetermined temperature B, the separation mechanism 50 may release the movement of the nip formation pad 26 such that the nip formation pad 26 contacts the fixing belt 21 with the nip pressure of the ordinary state, that is, the nip pressure in the fixing process.

This gives the same effect as the described above because detecting change of the temperature of the fixing belt 21 enables detecting when the first heated region of the fixing belt 21 reaches the position opposite the nip formation pad 26. In this case, setting the temperature sensor 40 near an entrance or an outlet side of the nip enables the fixing device to detect when the first heated region of the fixing belt 21 reaches the position opposite the nip formation pad 26 correctly.

A temperature sensor that detects a temperature on the pressing roller 31 may be provided. The processor 60 may proceed the warming-up operation from the second stage to the third stage based on the temperature detected by the temperature sensor.

The processor 60 may control to proceed the warming-up operation from the second stage to the third stage based on a result detected by the temperature sensor 40 after the predetermined time has passed from the start of the second stage of the warming-up operation. Alternatively, after the predetermined time has passed since the temperature detected by the temperature sensor 40 exceeds a predetermined temperature, the processor 60 may control to proceed the warming-up operation from the second stage to the third stage.

Preferably, various types of controls described above is set not to generate a wasted time because shortening both of time from the first stage to the second stage and time form the second stage to the third stage in the warming-up operation (the first warming-up operation) as long as possible shorten a recovery time that is a time from the start of the warming-up operation to the ordinary fixing process.

In the warming-up operation (the first warming-up operation) of the present embodiment, after the separation mechanism 50 releases the movement of the nip formation pad 26 such that the nip formation pad 26 contacts the fixing belt 21 at the nip pressure in an ordinary state as the third stage, the processor 60 controls the drive motor 61 as the driving unit so that the rotational speed of the pressing roller 31 and the fixing belt 21 becomes slow as the fourth stage.

That is, in the warming-up operation of the present embodiment, the rotational speed of the drive motor 61 that is a variable rotation speed motor after the start of the third stage before the ordinary fixing process is slower than that in the fixing process and the first stage.

This control prevents heat transfer from the fixing belt 21 to the pressing roller 31 via the nip and enables the temperature of the fixing belt 21 to raise a desired temperature for a short time.

In the present embodiment, the processor 60 executes the warming-up operation (the first warming-up operation) when the temperature sensor 40 serving as the temperature detector provided in the fixing device 20 detects a temperature equal to or less than a predetermined value A before the start of the fixing process, that is, before the drive motor 61 drives the fixing device 20.

When the temperature sensor 40 serving as the temperature detector detects a temperature more than the predetermined value A before the start of the fixing process, the processor 60 executes a second warming-up operation in which the nip formation pad 26 contacts the fixing belt 21 with the nip pressure of the ordinary state, that is, the nip pressure in the fixing process, the heater 25 as the heating means heats the fixing belt 21, and the drive motor 61 starts the rotation of the pressing roller 31 that drives rotation of the fixing belt 21.

Specifically, when the processor 60 of the image forming apparatus 1 receives a print instruction, the temperature sensor 40 detects the temperature of the fixing belt 21. Only when the detected temperature is equal to or less than the predetermined temperature A, the processor 60 executes the first warming-up operation. When the detected temperature is greater than the predetermined temperature A, the processor 60 executes the second warming-up operation instead of the first warming-up operation.

The second warming-up operation is an operation of idly driving the fixing device 20 under the same conditions as the ordinary fixing process, unlike the first warming-up operation.

The processor 60 executes such the second warming-up operation because a certain high temperature of the fixing belt 21 does not cool the lubricant interposed between the sheet member 22 on the nip formation pad 26 and the fixing belt 21. The lubricant is not led to a high viscosity state, in which a large driving torque of the fixing device 20 and the failure of rotation of the fixing belt 21 driven by the pressing roller 31 are more common. Therefore, when the temperature of the fixing belt 21 is high to a certain extent, the processor 60 executes the second warming-up operation under the same conditions as the ordinary fixing process and shortens the time of the warming-up operation executed before the fixing process.

In the present embodiment, the processor 60 determines whether the processor 60 executes the first warming-up operation based on the temperature of the fixing belt 21 detected by the temperature sensor 40.

The processor 60 may determine whether the processor 60 executes the first warming-up operation based on the temperature detected by a temperature sensor 110 disposed in the image forming apparatus 1. The temperature sensor 110 is illustrated in FIG. 1 and FIG. 2. Whether the temperature sensor 110 detects an external temperature of the image forming apparatus 1 or an internal temperature of the image forming apparatus 1, the temperature sensor 110 can predict the temperature of the lubricant described above to some extent. Therefore, the temperature sensor 110 can be used for the above described control.

The processor 60 may determine whether the processor 60 executes the first warming-up operation based on the temperature detected by another temperature sensor disposed in the fixing device 20 such as the temperature sensor that detects the temperature of the pressing roller 31 or a temperature sensor that detects a temperature of internal or external temperature of the fixing device 20 instead of the temperature sensor 40 that detects the temperature of the fixing belt 21. Since the temperature sensors in these cases can also predict the temperature of the lubricant described above to some extent, the temperature sensors can be used for the above described control.

Figure 7:
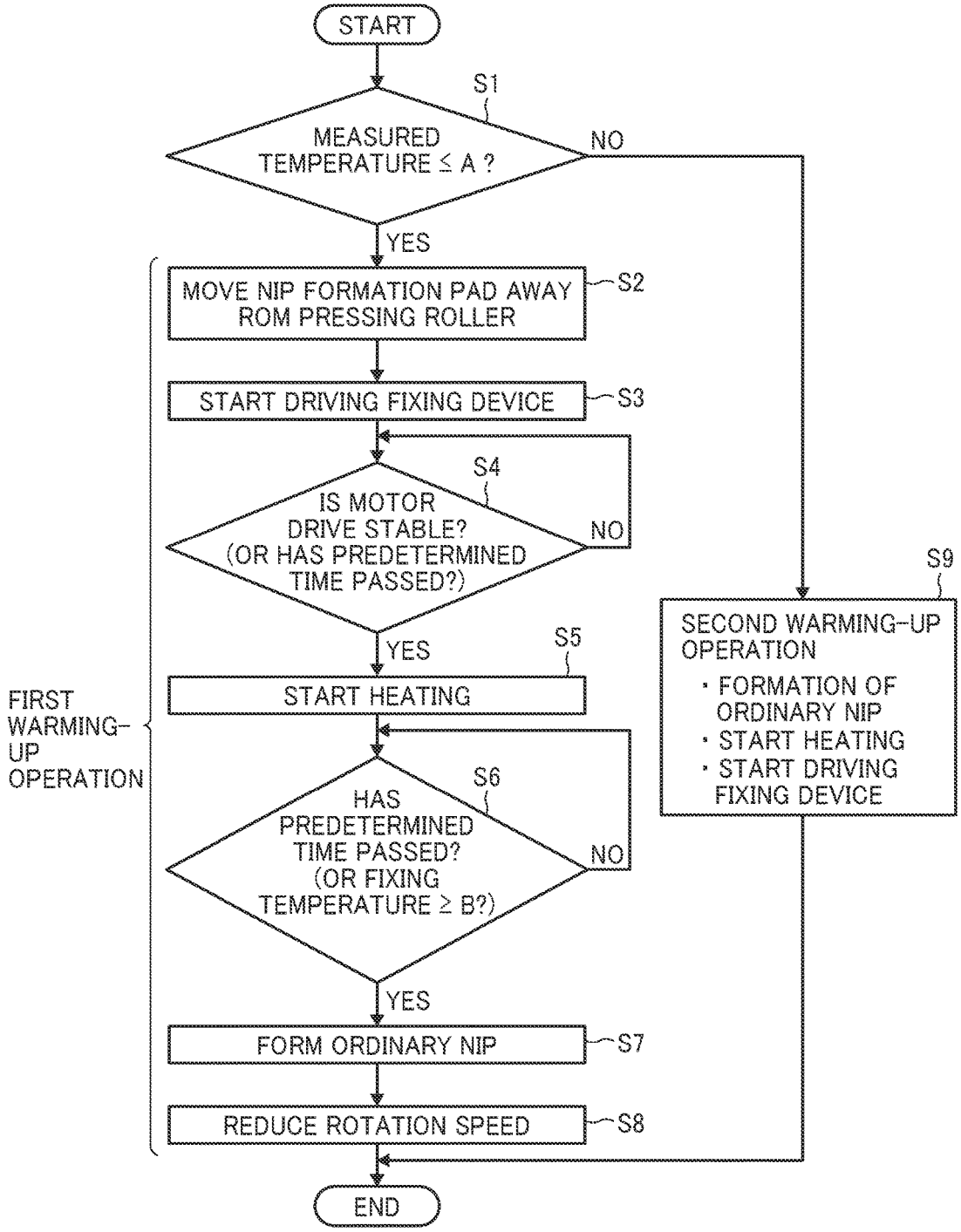
FIG. 7 is a flowchart illustrating a start-up control process of the fixing device.

Finally, with reference to FIG. 7, a flow chart of steps in a start-up control process of the fixing device 20 is described.

As illustrated in FIG. 7, when the processor 60 of the image forming apparatus 1 receives a print instruction, the processor 60 firstly determines whether the temperature measured by the temperature sensor 40 (or the temperature sensor 110) is equal to or less than the predetermined value A (step S1).

When the processor 60 determines that the temperature measured by the temperature sensor 40 is equal to or less than the predetermined value A, since the high viscosity of the lubricant causes the increase of the driving torque and the rotation failure of the fixing belt 21 driven by the pressing roller 31, the processor 60 starts the first warming-up operation and controls the separation mechanism 50 to move the nip formation pad 26 away from the pressing roller 31 (step S2) and the drive motor 61 to start driving the fixing device 20 (step S3) as the first stage.

Subsequently, the processor 60 determines whether the drive of the drive motor 61 is stable (step S4). When the processor 60 determines that the drive is stable, the heater 25 starts heating the fixing belt 21 as the second stage (step S5).

In step S6, the processor 60 determines whether the predetermined time has passed since the heater 25 starts the heating. When the processor 60 determines that the predetermined time has passed, as the third stage, the processor 60 controls the separation mechanism 50 to form the ordinary nip (step S7), and, at about the same timing, the processor 60 controls the drive motor 61 to reduce the rotational speed of the drive motor 61 (step S8). When the temperature of the fixing belt 21 reaches the desired temperature, the processor 60 completes the first warming-up operation. Then, the ordinary fixing process is executed.

When the processor 60 determines that the temperature detected by the temperature sensor 40 is greater than the predetermined value A in step S1, since the viscosity of the lubricant is low and the increase of the driving torque and the rotation failure of the fixing belt 21 driven by the pressing roller 31 is not caused, the processor 60 executes the second warming-up operation under the same conditions as the ordinary fixing process (step S9). When the temperature of the fixing belt 21 reaches the desired value, the processor 60 completes the second warming-up operation. Then, the ordinary fixing process is executed.

Variation

Figure 8A:
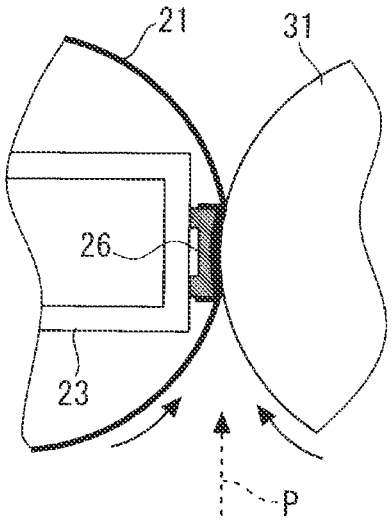
FIG. 8A is a schematic explanatory diagram illustrating a state in which the nip formation pad forms the nip at a normal nip pressure in a variation of the present embodiment.
Figure 8B:
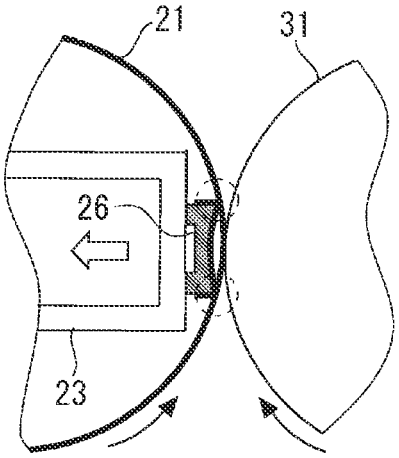
FIG. 8B is a schematic explanatory diagram illustrating a state in which the nip formation pad forms the nip at a low nip pressure in the variation of the present embodiment.

FIG. 8A is a schematic explanatory diagram illustrating a state in which the nip formation pad 26 forms the nip at an ordinary nip pressure in a variation, and FIG. 8B is a schematic explanatory diagram illustrating a state in which the nip formation pad 26 forms the nip at a low nip pressure in the variation. FIG. 8A and FIG. 8B correspond to FIG. 4A and FIG. 4B in the present embodiment, respectively.

As illustrated in FIG. 8B, in the fixing device 20 according to the variation, when the separation mechanism 50 moves the nip formation pad 26 (and the brace 23) away from the pressing roller 31 in the separation direction that is a left direction in FIG. 8B, the nip formation pad 26 does not separate from the inner circumferential surface of the fixing belt 21 perfectly, and a part of the nip formation pad 26, that is, a corner of the nip formation pad 26 contacts the inner circumferential surface of the fixing belt 21 (with weak pressure). In this state, operations from the first stage to the second stage at the first warming-up are performed.

That is, at the predetermined timing, the processor 60 in the variation executes the first warming-up operation in which the processor 60 controls the separation mechanism 50 to move the nip formation pad 26 in the separation direction so that the nip formation pad 26 contacts the fixing belt 21 with lower nip pressure than the ordinary nip pressure without heating the fixing belt 21 by the heater as the heating means, the heater 25 to start heating the fixing belt 21 after the pressing roller 31 that contacts the fixing belt 21 starts the rotation that rotates the fixing belt 21, and, after the rotation, the separation mechanism 50 to release the movement of the nip formation pad 26 such that the nip formation pad 26 contacts the fixing belt 21 with the ordinary nip pressure.

A configuration of the variation can attain effects similar to the present embodiment.

As described above, in the fixing device 20 of the present embodiment, at the predetermined timing, the processor 60 executes the warming-up operation (the first warming-up operation) in which the processor 60 controls the separation mechanism 50 to move the nip formation pad 26 in the separation direction so that the nip formation pad 26 contacts the fixing belt 21 with lower nip pressure than the ordinary nip pressure or zero nip pressure without heating the fixing belt 21 by the heater 25 as the heating means, the heater 25 to start heating the fixing belt 21 after the pressing roller 31 that contacts the fixing belt 21 starts the rotation that rotates the fixing belt 21, and, after the rotation, the separation mechanism 50 to release the movement of the nip formation pad 26 such that the nip formation pad 26 contacts the fixing belt 21 with the ordinary nip pressure.

Since the driving torque of the fixing device 20 does not become so large even when the viscosity of the lubricant becomes high at the start of the driving of the fixing device 20, this prevents the disadvantage caused by the fixing belt 21 a part of which is heated by the heater 25 because the fixing belt 21 is not sufficiently and stably rotated by the pressing roller 31.

In the present embodiment, the heater 25 serves as a heat source that heats the fixing belt 21, but heat source to heat the fixing belt 21 is not limited this. Alternatively, for example, an electromagnetic induction coil or a resistance heat generator may be used as a heat source for heating the fixing belt 21.

In such configurations, effects similar to those described above are also attained.

The present disclosure is not limited to the above-described embodiments, and the configuration of the present embodiment can be appropriately modified other than suggested in each of the above embodiments within the scope of the technological concept of the present disclosure. Also, the position, shape, and number of components are not limited to the embodiments described above, and may be modified suitably in implementing the disclosure.

In the present disclosure, the term "width direction" means a direction perpendicular to the conveyance direction of the sheet and the same direction as the rotational axis of the fixing belt 21 and the pressing roller 31.

In the present disclosure, the term "grease" means a liquid lubricating oil or other liquid lubricating oil to which a thickening agent is added, which is semi-solid or semi-fluid at room temperature.

Numerous additional modifications and variations are possible considering the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A fixing device comprising:

a driving unit;

a pressing roller rotated in a predetermined direction by the driving unit;

a heater;

a fixing belt heated by the heater, the fixing belt driven and rotated by friction between the pressing roller and the fixing belt;

a nip formation pad that presses against an inner circumferential surface of the fixing belt toward the pressing roller via the fixing belt to form a nip through which a sheet is conveyed;

a separation mechanism to lower a nip pressure of the nip formation pad with respect to the pressing roller;

a lubricant in a portion where the fixing belt comes into sliding contact with the nip formation pad; and a processor to execute a warming-up operation at a predetermined timing, and configured to:

control the separation mechanism to lower the nip pressure before the heater heats the fixing belt, and cause the nip formation pad to contact the fixing belt with the nip pressure lower than an ordinary nip pressure, or release the nip formation pad from the fixing belt to set the nip pressure to zero;

after the separation mechanism lowers the nip pressure, control the driving unit to start rotation of the pressing roller that contacts and rotates the fixing belt;

after the rotation of the pressing roller, control the heater to start heating the fixing belt; and after the heater starts heating, control the separation mechanism to increase the nip pressure, and cause the nip formation pad to contact the fixing belt at the ordinary nip pressure while the fixing belt continues to rotate.

2. The fixing device according to claim 1, wherein the driving unit is a drive motor, the processor controls the drive motor to start the rotation of the pressing roller that causes the rotation of the fixing belt when the processor starts the warming-up operation, and the processor controls the heater to start heating the fixing belt after rotation of the drive motor becomes stable.

3. The fixing device according to claim 1, wherein the processor controls the heater to start heating the fixing belt after a predetermined time has passed from a start of the rotation of the pressing roller that rotates the fixing belt in the warming-up operation.

4. The fixing device according to claim 1, wherein the processor controls the separation mechanism to increase the nip pressure and cause the nip formation pad to contact the fixing belt at the ordinary nip pressure after a predetermined time has passed once the heater starts heating the fixing belt in the warming-up operation.

5. The fixing device according to claim 1, further comprising a temperature sensor to detect at least one of a temperature of the fixing belt and a temperature of the pressing roller, wherein the processor controls the separation mechanism to increase the nip pressure and cause the nip formation pad to contact the fixing belt at the ordinary nip pressure after the temperature detected by the temperature sensor exceeds a predetermined value once the heater starts heating the fixing belt in the warming-up operation.

6. The fixing device according to claim 1, wherein the processor controls the driving unit to reduce rotation speeds of the pressing roller and the fixing belt after the separation mechanism increases the nip pressure and causes the nip formation pad to contact the fixing belt at the ordinary nip pressure in the warming-up operation.

7. The fixing device according to claim 1, wherein the lubricant is grease.

8. The fixing device according to claim 1, further comprising a temperature sensor disposed in at least one of the fixing device and an image forming apparatus, wherein the processor executes the warming-up operation when a temperature detected by the temperature sensor before a fixing process starts is equal to or less than a predetermined value.

9. The fixing device according to claim 8, wherein, when the temperature detected by the temperature sensor before the fixing process starts is more than the predetermined value, the processor executes a second warming-up operation in which the nip formation pad contacts the fixing belt at the ordinary nip pressure and the pressing roller that rotates the fixing belt starts to rotate while the heater heats the fixing belt.

10. An image forming apparatus comprising the fixing device according to claim 1.

* * * * *